US005699999A

United States Patent [19]

Wells

[11] Patent Number: 5,699,999

[45] Date of Patent: Dec. 23, 1997

[54] ALIGNED MATTRESS SPRING CORE

[75] Inventor: Thomas J. Wells, Carthage, Mo.

[73] Assignee: L&P Property Management Company, Chicago, Ill.

[21] Appl. No.: 645,246

[22] Filed: May 13, 1996

Related U.S. Application Data

[63] Continuation-in-part of Ser. No. 52,737, Apr. 2, 1996, Pat. No. Des. 382,427.

[51] Int. Cl.[6] ..... F16F 3/06; A47C 25/00

[52] U.S. Cl. ..... 267/103; 5/256; 267/91

[58] Field of Search ..... 267/91, 92, 103, 267/107, 110; 248/248, 256

[56] References Cited

U.S. PATENT DOCUMENTS

| | | | |
|---|---|---|---|
| 3,161,408 | 12/1964 | Molt | 5/256 |
| 3,653,081 | 4/1972 | Davis | 5/256 |
| 3,716,874 | 2/1973 | Thomas, Jr. | 5/256 |
| 4,609,186 | 9/1986 | Thoenen | 267/91 |
| 4,726,572 | 2/1988 | Flesher et al. | 5/248 |
| 4,781,360 | 11/1988 | Ramsey | 267/91 |
| 4,817,924 | 4/1989 | Thoenen | 267/91 |
| 5,509,642 | 4/1996 | Wells | 5/248 |
| 5,584,083 | 12/1996 | Ramsey et al. | 5/256 |

*Primary Examiner*—Robert J. Oberleitner
*Assistant Examiner*—Chris Schwartz
*Attorney, Agent, or Firm*—Wood, Herron & Evans, L.L.P.

[57] ABSTRACT

A mattress inner spring core comprising a plurality of coil springs arranged in longitudinally extending columns and transversely extending rows. Each coil spring has an identically configured upper and lower end turn between which are a plurality of central convolutions defining a spring axis. Each end turn comprises first and second offset legs connected by a linear base web. A portion of a first leg of one end turn overlaps a portion of a second leg of an adjacent end turn in an overlapping region. Helical lacing wires encircle the legs of adjacent end turns to connect rows of springs. Each helical lacing wire has multiple revolutions encircling the overlapped legs of adjacent end turns with the same number of revolutions of the lacing wire encircling the overlapped portions of the legs and at least one complete revolution encircling a non-overlapped portion of the first and second legs of the end turns.

11 Claims, 3 Drawing Sheets

ALIGNED MATTRESS SPRING CORE

CROSS-REFERENCE TO RELATED APPLICATIONS

This application is a Continuation-In-Part of U.S. design application Ser. No. 29/052,737 filed Apr. 2, 1996 now U.S. Pat. No. Des. 382,427 which application is herein incorporated by reference in its entirety.

FIELD OF INVENTION

The present invention relates to bedding mattresses and more particularly to the spring interior of a bedding mattress.

DESCRIPTION OF THE PRIOR ART

The interior spring core of a conventional mattress generally comprises a plurality of side by side transversely extending rows and longitudinally extending columns of identically configured coil springs. Each coil spring is typically made out of a single piece of wire and has an upper and lower end turn disposed in upper and lower planes, respectively of the spring core. The coil springs are generally held together in an assembled relation by a plurality of helical lacing wires located in the upper and lower planes of the spring core. The helical lacing wires extend parallel to one another either longitudinally or transversely and connect adjacent rows or columns of coil springs in the upper and lower planes of the inner spring core. Surrounding the spring core in the upper and lower planes of the spring core there are generally two rectangular border wires secured to the spring core by conventional clips or other fasteners.

Typically both the top and bottom surfaces of the spring core of a mattress are covered with one or more layers of padding. The spring core and padding are then encased in a fabric covering by the manufacturer of the mattress.

When a mattress spring core is being assembled typically rows or columns of coils springs are lined up and then laced together by a helical lacing machine. The lacing machine rotates and wraps a helical lacing wire around adjoining legs of end turns of coil springs in the upper and lower planes of the spring core. As explained in U.S. Pat. No. 4,817,924, in order for the end turns of the coil springs to remain aligned in linear rows and columns, the helical lacing wires must wrap one more revolution around one of the legs of an end turn than it wraps around the adjoining leg of the adjacent end turn. This unequal number of wraps of lacing wire around adjacent legs of adjacent coils allows the coil springs to remain linearly aligned in rows and columns even though the pitch of the helical lacing wire tends to force the adjacent coils into misalignment. If the helical lacing wires were wrapped the same number of revolutions around each leg, as explained in the above-identified U.S. Pat. No. 4,817,924, the coils would be offset or skewed and the resulting mattress would not be of a generally rectangular shape, but more in the shape of a rhombus.

It has been one objective of the present invention to provide a mattress spring core which utilizes helical lacing wires to connect adjacent legs of adjacent end turns of adjacent coil springs by encircling the legs the same number of revolutions without the spring core being offset or skewed.

It has been another objective of the present invention to provide a mattress spring core which utilizes helical lacing wires to connect adjacent legs of coil springs wherein the helical lacing wires encircle each leg of adjacent coil springs the same number of revolutions while maintaining the coil springs aligned in linear rows and columns.

SUMMARY OF THE INVENTION

The inner spring core of the present invention which accomplishes these objectives comprises a plurality of coil springs arranged in longitudinally extending columns and transversely extending rows between the border wires. Each coils spring is formed of a single piece of wire and has an upper end turn disposed in the first plane and a lower end turn disposed in the second plane. Between the end turns of each coil spring are a plurality of central convolutions which define a central spring axis. Each end turn is generally U-shaped and has a pair of opposed offsets defining a first and second leg connected by a base web. Adjacent end turns of adjacent coil springs are arranged such that a first portion of a first leg of one end turn overlaps a first portion of a second leg of an adjacent end turn in an overlapping region. In accordance with the practice of this invention, each of the overlapping first and second legs of the U-turns has a second portion which is not overlapped.

The end turns of the coil springs are connected together with a plurality of parallel helical lacing wires. Each helical lacing wire comprises multiple revolutions which encircle overlapping first and second legs of adjacent end turns. Each helical lacing wire comprises multiple revolutions which encircle the overlapped region of adjacent end turns and at least one complete revolution which encircles the second unoverlapped portions of adjacent first and second legs of the adjacent end turns. The second unoverlapped portions of the first and second legs are on opposite ends of the overlapped region of the adjacent end turns.

Each helical lacing wire is separated into a plurality of connecting portions which are spaced apart and function to connect adjacent end turns of adjacent coil springs by encircling the end turns in three separate sections. The first section of the connecting portion encircles a first leg of one end turn alone. A second section of the connecting portion of the helical lacing wire encircles the overlapped region of adjacent legs of adjacent end turns. The third section of the connecting portion of the helical lacing wire encircles only the second leg of the second end turn. Between the connecting portions are gaps in which the revolutions of the helical lacing wire do not encircle any portion of the coil springs of the assembly. The connecting portion of the helical lacing wire encircles the overlapped region of adjacent end turns the same number of revolutions.

In the preferred practice of the invention of this application, the configuration of the end turns of the springs are identical. Each end turn comprises two legs which are offset relative to one another in the direction in which the helical lacing wires extend. The legs of each end turn are connected by a base web which is generally linear and extends at an acute angle to a plane defined by the axes of the overlapped coil springs. The angulation of the base web enables the legs of adjacent overlapped springs to be offset relative to one another in the direction in which the helical lacing wires extend. This offset allows first and second legs of adjacent end turns to be overlapped and to be wrapped with the same number of revolutions of a helical lacing wire while still maintaining straight line linear alignment of the rows and columns of laced spring. A resulting rectangular shaped mattress may thereby be more easily assembled.

DESCRIPTION OF THE PREFERRED EMBODIMENT

Figure 1:
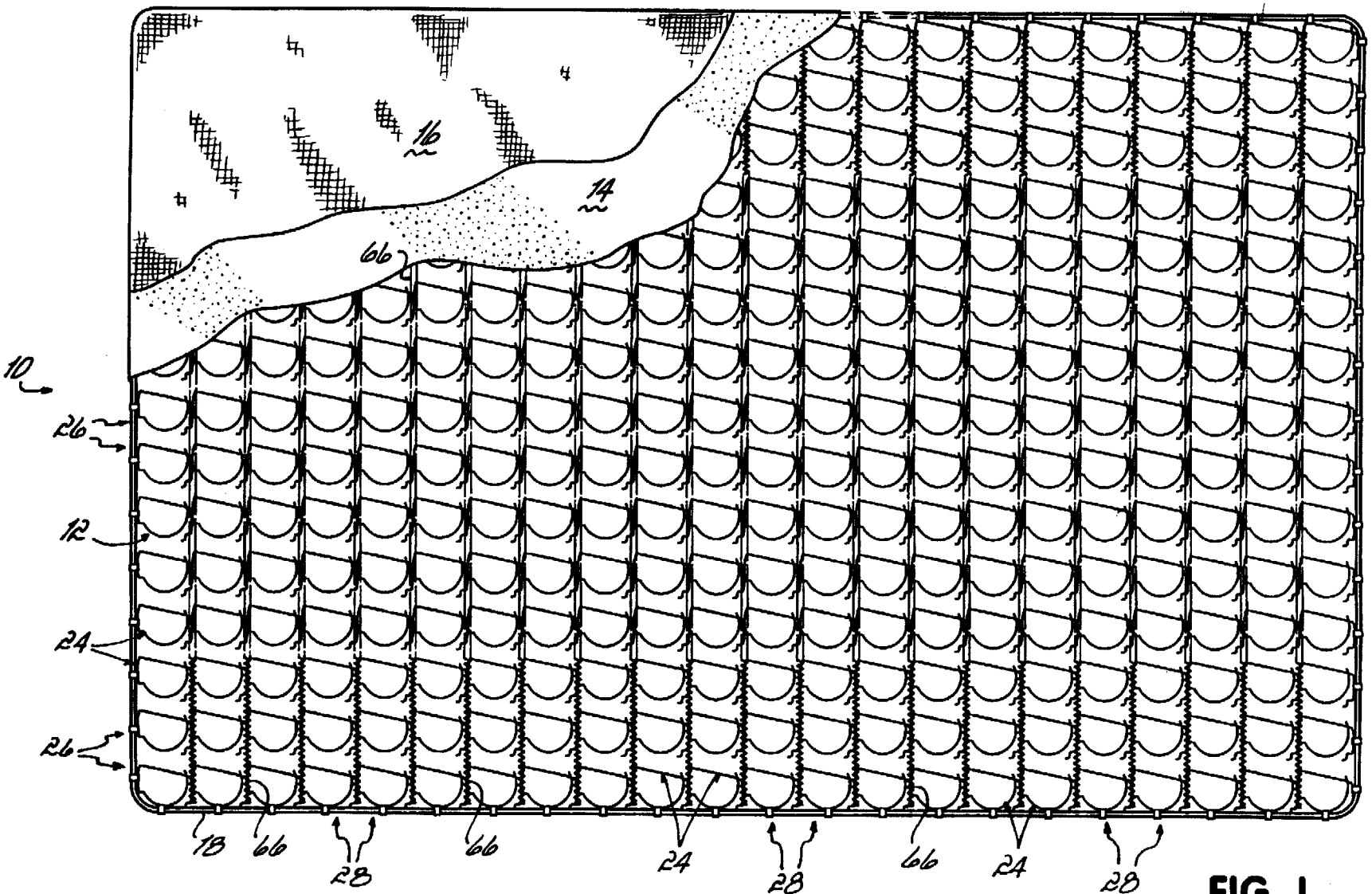
FIG. 1 is a top plan view of the mattress of the present invention.

Referring to the drawings, and particularly to FIG. 1 there is illustrated a fully assembled mattress 10 comprising an inner spring core 12, a mattress pad 14 and an upholstered fabric covering 16 encircling the mattress pad and inner spring core.

Figure 3:
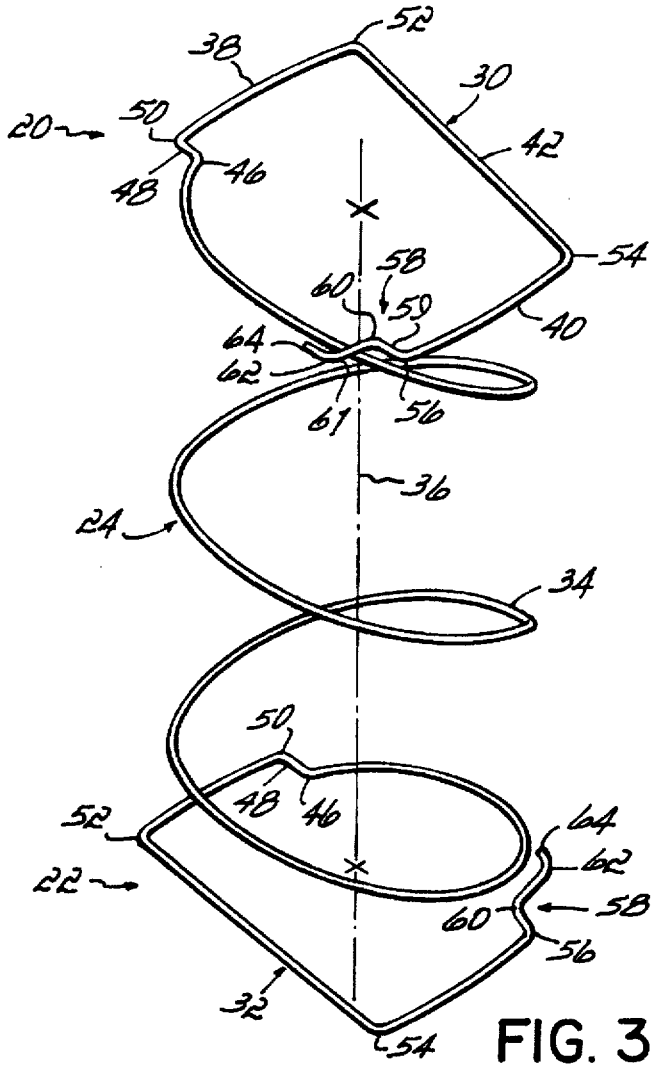
FIG. 3 is a perspective view of one coil spring utilized in the mattress of the present invention.
Figure 4:
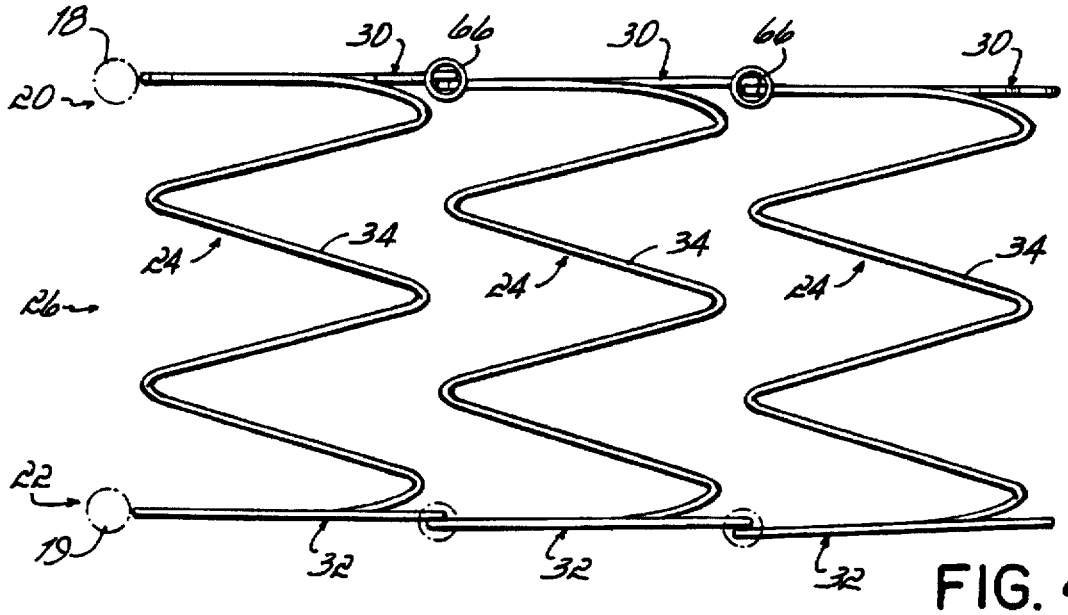
FIG. 4 is a view taken along the line 4—4 of FIG. 2.

The inner spring core of the present invention comprises a first generally rectangular border wire 18 in a first or top plane 20 and a second generally rectangular border wire 19 in a second or lower plane 22 (see FIG. 4). The border wires 18, 19 are identically configured and spaced from each other. Between the border wires 18, 19 are a plurality of coil springs 24 arranged in longitudinally extending columns 26 and transversely extending rows 28. As best illustrated in FIG. 3, each coil spring 24 is made of a single piece of wire having an upper end turn 30 in the upper or first plane 20, a lower end turn 32 located in the lower or second plane 22, and a plurality of central convolutions 34 located between the end turns and defining a central spring axis 36.

Each end turn 30, 32 is generally U-shaped and comprises a first leg 38 and a second leg 40 connected by a base web 42. The base web 42 is generally linear and extends at an acute angle to a plane 44 defined by the axes of adjacent coil springs within a column 26 (see FIG. 2).

Figure 2:
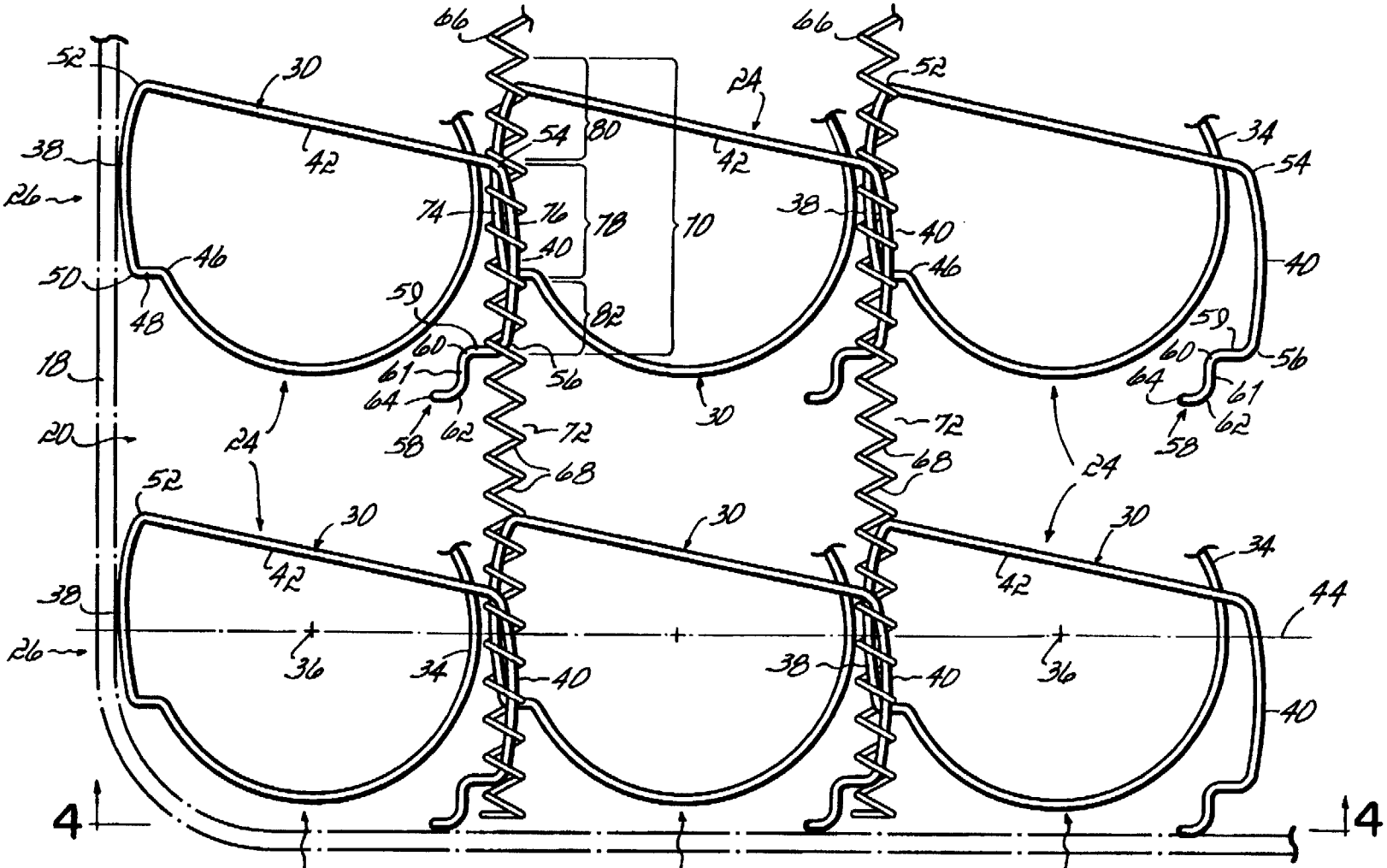
FIG. 2 is an enlarged top plan view of one corner of the mattress of FIG. 1.

As best illustrated in FIG. 2 and 3, all end turns are identically configured and begin with a first bend 46 which begins at the end of the central convolutions 34 of each coil spring 24. Extending generally outwardly from the first bend and away from the axis of the coil spring is a first portion 48 of the end turn which is relatively short in length and terminates at a second bend 50. The second bend 50 is the beginning of the first leg 38 of the end turn. The first leg 38 is slightly arcuate and terminates in a third bend 52. The third bend 52 begins the base web 42 of the end turn. The base web 42 is at an acute angle to a plane 44 defined by the axes 36 of adjacent coil springs within a column 26 of springs. The base web 42 extends from the third bend 52 to a fourth bend 54 which is located at the beginning of the second leg 40. The second leg 40 is also arcuate and extends from the fourth bend 54 to a fifth bend 56. At the fifth bend 56 the end turn extends into a tail portion 58 which comprises respectively, a straight section 59, a sixth bend 60, a straight section 61, and a seventh bend 62 and inwardly bent end 64. In the preferred embodiment of the invention, the first, second, third, fourth and fifth bends of each end turn are respectively approximately 120°, 100°, 95°, 120° and 95°. The sixth and seventh bends are respectively approximately 90° each.

As best seen in FIGS. 1 and 2, a plurality of parallel helical lacing wires 66 connect the end turns of adjacent coil springs. FIG. 1 shows the helical lacing wires 66 extending transversely of the mattress connecting adjacent rows 28 of springs together but the helical lacing wires 66 may alternatively extend longitudinally of the mattress 10 and connect adjacent columns of springs.

Each helical lacing wire 66 comprises a multiplicity of revolutions 68. Each helical lacing wire 66 has a plurality of evenly spaced connecting portions 70 which connect end turns of adjacent springs 24 by wrapping around the legs of the adjacent end turns. Between connecting portions 70 of the lacing wires are gaps 72 between adjacent columns 26 of coil springs 24 in which the revolutions 68 of the helical lacing wires 66 do not encircle either leg 38 or 40 of the end turns of the springs 24.

Two adjacent end turns 30 of adjacent springs 24 are arranged such that a first portion 74 of a first leg 38 of one end turn overlaps a first portion 76 of a second leg 40 of the adjacent end turn in an overlapping region 78. A second portion 80 of the first leg 38 of the end turn extends beyond and does not overlap with the second leg 40 of the adjacent end turn, as best seen in FIG. 2. The second leg 40 of the adjacent end turn also has a non-overlapping portion 82 which extends beyond the overlapping region 78 of the end turns as seen in FIG. 2.

Each helical lacing wire 66 has multiple revolutions 68 encircling the overlapped region 78 of adjacent end turns and at least one complete revolution encircling the second portions 80, 82 of the first and second legs 38, 40. The second portion 80 of the first leg 38 lies at one end of the overlapping region of the end turns 78 and the second portion 82 of the second leg 40 is located at the opposite end of the overlapping region of the end turns 78 as best seen in FIG. 2.

Due to the offset configuration of the base webs 42 of the end turns 30, 32 relative to a plane containing the axes 36 of a column 26 of springs 24, the helical lacing wires 66 may encircle both overlapped legs 38, 40 of adjacent end turns 30, 32 with the exact same number of revolutions (see FIG. 2) of the lacing wire 66 and still maintain straight line alignment of the columns 26 of springs 24. Several revolutions 68 of each connecting portion of each helical lacing wire 66 encircle the overlapping region 78 of the end turns 30, 32 and also several revolutions 68 encircle the non-overlapping second portions 80, 82 of both the first and second legs 38, 40 of the end turns 30, 32 on both sides of the overlapping region 78.

Each connecting portion 70 of each helical lacing wire 66 connects two adjacent end turns 30, 32 by encircling adjacent legs 38, 40 of the end turns in three separate sections. A first section of each connecting portion 70 of the helical lacing wire 66 encircles the non-overlapping second portion 80 of the first leg 38 of one end turn. The second section of the connecting portion 70 of the helical lacing wire 66 encircles the overlapping region 78 of adjacent end turns. The third section of the connecting portion 70 of the helical lacing wire 66 encircles only the non-overlapping second portion 82 of the second leg 40. The helical lacing wires 66 do not encircle the tail portions 58 of the second legs 40 of the end turns.

The unique configuration of the end turns of the coil springs and the unique arrangement and relationship of the first and second legs of the end turns of the springs relative to the revolutions of the helical lacing wires described hereinabove enables a manufacturer to assemble rows and columns of a spring core in a straight line linear fashion, thus ensuring a rectangular inner spring core as opposed to an inner spring core which becomes offset and forms into the shape of a rhombus.

While I have described only one preferred embodiment of my invention, those skilled in the art will appreciate numerous changes and modifications which may be made without departing from the spirits of my invention. For example, those skilled in the art will readily appreciate that the springs and particularly the end turns of the springs may be varied in shape and configuration without departing from my invention. Furthermore, those skilled in the art will appreciate that the springs may be either unknotted coil springs or knotted offset style springs. Therefore, I do not intend to be limited except by the scope of the following claims:

I claim:

1. A mattress comprising:

an inner spring core comprising a plurality of coil springs arranged in longitudinally extending columns and transversely extending rows, each coil spring being of a single piece of wire having an upper end turn in a first plane, a lower end turn in a second plane and a plurality of central convolutions between said end turns defining a central spring axis, each end turn having a first and second leg connected by a base web, said end turns being arranged such that a first portion of a first leg of one end turn of one coil spring overlaps a first portion of a second leg of an adjacent end turn of an adjacent coil spring in an overlapping region, each of said first and second legs of each of said end turns also having second portions thereof which are not overlapped, a plurality of parallel helical lacing wires connecting adjacent rows of said springs of said core, each helical lacing wire comprising multiple revolutions encircling said overlapped region of adjacent end turns of adjacent springs and at least one complete revolution encircling said second portions of said first and second legs, a mattress pad; and an upholstered fabric covering encasing said inner spring core and said mattress pad.

2. A mattress inner spring core comprising:

a plurality of coil springs arranged in longitudinally extending columns and transversely extending rows, each coil spring being of a single piece of wire having an upper end turn in said first plane, a lower end turn in said second plane and a plurality of central convolutions between said end turns defining a central spring axis, each end turn comprising a first and second leg connected by a base web, said end turns being arranged such that a first portion of a first leg of one end turn of one coil spring overlaps a first portion of a second leg of an adjacent end turn of an adjacent coil spring in an overlapping region, each of said first and second legs of each of said end turns also having second portions thereof which are not overlapped, a plurality of parallel helical lacing wires connecting said end turns of said coil springs, each helical lacing wire comprising multiple revolutions encircling said overlapped region of adjacent end turns and at least one complete revolution encircling said second portions of said first and second legs.

3. The mattress inner spring core of claim 2 wherein each helical lacing wire encircles a first leg of an end turn and a second leg of an adjacent end turn the same number of revolutions.

4. The mattress inner spring core of claim 2 wherein each helical lacing wire encircles said second portion of said first leg on one end of said overlapping region and said helical lacing wire encircles said second portion of said second leg of the adjacent end turn on an opposite end of said overlapping region.

5. The mattress inner spring core of claim 2 wherein each helical lacing wire encircles said second portions of adjacent overlapping legs the same number of revolutions.

6. A mattress inner spring core comprising:

a plurality of coil springs arranged in longitudinally extending columns and transversely extending rows, each coil spring being made of a single piece of wire having an upper end turn in a first plane, a lower end turn in a second plane and a plurality of central convolutions between said end turns defining a central spring axis, each end turn comprising a first and second leg connected by a base web, said end turns being arranged such that a first leg of one end turn of one coil spring overlaps a second leg of an adjacent end turn of an adjacent coil spring in an overlapping region, a plurality of parallel helical lacing wires connecting said rows of coil springs, each helical lacing wire comprising multiple spaced connecting portions, each connecting portion of each helical lacing wire connecting two adjacent end turns by encircling said end turns in three sections, a first section in which said helical lacing wire encircles a first leg of one end turn of one coil spring, a second section in which said helical lacing wire encircles said overlapped region of adjacent end turns and a third section in which said helical lacing wire encircles a second leg of a second end turn of said adjacent coil spring.

7. The mattress inner spring core of claim 6 wherein each helical lacing wire encircles a first leg of an end turn and a second leg of an adjacent end turn the same number of revolutions within a connecting portion.

8. The mattress inner spring core of claim 6 wherein each second section of helical lacing wire encircles a first leg of an end turn and a second leg of an adjacent end turn the same number of revolutions within an overlapped region.

9. The mattress inner spring core of claim 6 wherein said base web of each end turn is generally straight line linear.

10. The mattress inner spring core of claim 9 wherein said base web of each end turn extends at an arcuate angle to a plane defined by the axes of said coil springs.

11. The mattress inner spring core of claim 10 wherein said first and second legs of each end turn are offset relative to one another in the direction of the axis of the helical lacing wires.

* * * * *